US007530150B2

(12) United States Patent
Brennan et al.

(10) Patent No.: US 7,530,150 B2
(45) Date of Patent: May 12, 2009

(54) PROCESS AND APPARATUS FOR PREPARING A MOLDED, TEXTURED, SPUNLACED, NONWOVEN WEB

(75) Inventors: Jonathan Paul Brennan, Cincinnati, OH (US); Lester Charles Sporing, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 42 days.

(21) Appl. No.: 11/890,195

(22) Filed: Aug. 3, 2007

(65) Prior Publication Data

US 2007/0273069 A1 Nov. 29, 2007

Related U.S. Application Data

(62) Division of application No. 10/706,375, filed on Nov. 12, 2003, now abandoned.

(60) Provisional application No. 60/425,443, filed on Nov. 12, 2002.

(51) Int. Cl.
*D04H 1/46* (2006.01)

(52) U.S. Cl. ..... 28/104; 28/167

(58) Field of Classification Search ..... 28/104, 28/105, 167, 106; 162/115, 109; 264/500, 264/504, 570

See application file for complete search history.

(56) References Cited

U.S. PATENT DOCUMENTS 3,485,706 A 12/1969 Evans
3,769,659 A * 11/1973 Kalwaites ..... 28/104
3,786,615 A 1/1974 Bauer
3,800,364 A 4/1974 Kalwaites
3,917,785 A 11/1975 Kalwaites
4,379,799 A 4/1983 Holmes et al.
4,514,345 A 4/1985 Johnson et al.
4,528,239 A 7/1985 Trokhan
4,637,859 A 1/1987 Trokhan
4,665,597 A 5/1987 Suzuki et al.
4,718,152 A 1/1988 Suzuki et al.
4,741,944 A 5/1988 Jackson et al.
4,868,958 A 9/1989 Suzuki et al.
5,043,155 A 8/1991 Puchalski et al.
5,098,522 A 3/1992 Smurkoski et al.
5,115,544 A 5/1992 Widen
5,245,025 A 9/1993 Trokhan et al.
5,301,401 A * 4/1994 Suzuki et al. ..... 28/167
5,332,118 A 7/1994 Muckenfuhs
5,540,332 A 7/1996 Kopacz et al.
5,648,083 A 7/1997 Blieszner et al.
5,871,763 A 2/1999 Luu et al.
5,888,524 A 3/1999 Cole
5,895,623 A 4/1999 Trokhan et al.

(Continued)

FOREIGN PATENT DOCUMENTS

GB 1 353 756 5/1974

(Continued)

*Primary Examiner*—Amy B Vanatta
(74) *Attorney, Agent, or Firm*—Charles R. Matson

(57) ABSTRACT

A process for preparing a molded, textured, spunlaced, nonwoven web is provided and wipes made therefrom. Also provided is an apparatus for making molded, textured, spunlaced, nonwoven web. Molded, textured, spunlaced, nonwoven webs prepared by the inventive process and apparatus are also provided. Also provided is a molded, textured, spunlaced, nonwoven web.

15 Claims, 14 Drawing Sheets

U.S. PATENT DOCUMENTS

| | | | | |
|---|---|---|---|---|
| 5,964,351 | A | 10/1999 | Zander | |
| 6,030,331 | A | 2/2000 | Zander | |
| 6,055,710 | A * | 5/2000 | Fleissner | 28/104 |
| 6,083,854 | A | 7/2000 | Bogdanski et al. | |
| 6,202,845 | B1 | 3/2001 | Hill | |
| 6,207,596 | B1 | 3/2001 | Rourke et al. | |
| 6,213,344 | B1 | 4/2001 | Hill | |
| 6,250,495 | B1 | 6/2001 | Bando | |
| 6,300,301 | B1 | 10/2001 | Moore et al. | |
| 6,338,187 | B1 * | 1/2002 | Fleissner | 28/106 |
| 6,361,784 | B1 | 3/2002 | Brennan et al. | |
| 6,440,437 | B1 | 8/2002 | Krzysik et al. | |
| 6,796,010 | B2 * | 9/2004 | Noelle | 28/104 |
| 2002/0100153 | A1 * | 8/2002 | Takai et al. | 28/104 |
| 2003/0088956 | A1 * | 5/2003 | Strandqvist et al. | 28/104 |
| 2005/0022954 | A1 * | 2/2005 | Strandqvist | 162/115 |
| 2005/0155200 | A1 * | 7/2005 | Fleissner | 28/104 |

FOREIGN PATENT DOCUMENTS

| | | |
|---|---|---|
| JP | 07-145543 | 6/1995 |

* cited by examiner

PROCESS AND APPARATUS FOR PREPARING A MOLDED, TEXTURED, SPUNLACED, NONWOVEN WEB

CROSS REFERENCE TO RELATED APPLICATIONS

This application is a divisional of application Ser. No. 10/706,375, filed Nov. 12, 2003 now abandoned, which claims the benefit of U.S. Provisional Application No. 60/425,443, filed Nov. 12, 2002, both of which are hereby incorporated by reference.

FIELD OF INVENTION

A process for preparing a molded, textured, spunlaced, nonwoven web is provided and wipes made therefrom. Also provided is an apparatus for making molded, textured, spunlaced, nonwoven web. Molded, textured, spunlaced, nonwoven webs prepared by the inventive process and apparatus are also provided. Also provided is a molded, textured, spunlaced, nonwoven web.

BACKGROUND OF THE INVENTION

Historically, various types of nonwoven webs have been utilized for use as disposable wet wipes. The various types of nonwovens used differ in visual and tactile properties, usually due to the particular production process used in their manufacture. In all cases, however, consumers of disposable wipes suitable for use as baby wipes demand strength, thickness, flexibility, texture and softness in addition to other functional attributes such as cleaning ability. Strength, thickness and flexibility can be correlated to certain measurable physical parameters, but perceived softness and texture are often more subjective in nature, and consumers often react to visual and tactile properties in their assessment of wet wipes. Optimizing all the desirable properties is often not possible. For example, often a balance of properties results in less than desirable softness or strength levels. Wet wipes used as baby wipes, for example, should be strong enough when wet to maintain integrity in use, but soft enough to give a pleasing and comfortable tactile sensation to the user(s). They should have fluid retention properties such that they remain wet during storage, and sufficient thickness, porosity, and texture to be effective in cleaning the soiled skin of a user. In addition, sufficient thickness and texture should be retained when wet after formation or combined with a lotion or composition to make a wipe.

Strength in a nonwoven web can be generated by a variety of known methods. If thermoplastic fibers are used, strength can be imparted by melting, either by through-air bonding or by hot roll calendaring. Adhesive bonding is also commonly used to bind fibers to increase the strength of the nonwoven. However, these processes, while increasing the strength of the nonwoven, generally detract from other desirable properties, such as softness and flexibility. Hydroentangling a fibrous structure generates nonwovens with high softness, flexibility and strength, but typically reduces the thickness of the material. Such a reduction in thickness is undesirable for many applications of nonwoven webs, such as in a wet wipe application. Due to the nature of cleaning tasks for which wet wipes are used, consumers prefer a wipe that has a high amount of apparent bulk, or thickness associated with it. To increase the basis weight of the starting material such that after hydroentangling the material retains sufficient thickness to be used as a baby wipe would be prohibitively expensive.

There, however, remains the need for a nonwoven web, which has the softness and flexibility associated with a hydroentangled nonwoven web, but retains the thickness lost in the hydroentangling process. There is also a need for a nonwoven web which has the softness and flexibility associated with a hydroentangled nonwoven web and retains sufficient thickness and texture when wet after formation or combined with a lotion or composition to make a wipe. Similarly, there is also a need for a nonwoven web, which has the thickness associated with a through-air bonded or adhesive bonded nonwoven web, but retains the softness and flexibility lost in the through-air bonding or adhesive bonding processes.

SUMMARY OF THE INVENTION

A first aspect of the present invention provides a process for forming a molded, textured, spunlaced, nonwoven web from a fibrous substrate preform comprising the step of placing the fibrous substrate preform in contact with a forming screen, the forming screen comprising an upper mesh member (or its equivalent structure) having a height, $h_c$ and an underlying mesh member (or its equivalent structure) in intimate contact with the upper mesh member, while concurrently subjecting the substrate to a hydroentanglement process, the fibrous substrate preform having an average fiber length, $f_l$ and provided that $f_l$ is greater than $h_c$.

A second aspect of the present invention provides an apparatus for forming a textured spunlaced nonwoven web comprising (a) a forming screen, the forming screen comprising an upper mesh member (or its equivalent structure) having an effective open diameter, $d_c$ and an underlying mesh member having an effective open diameter, $d_f$ in intimate contact with the upper mesh member, wherein $d_c^2/d_f^2$ is greater than or equal to about 50 and is less than or equal to about 300; and (b) a hydroentanglement means in association with the forming screen.

A third aspect of the present invention provides a molded, textured, spunlaced, nonwoven web comprising fibers having an average length of from about 10 mm to about 60 mm, wherein the web has a surface comprising a pattern of valleys and land areas such that the valleys between the land areas are interconnected and each of the valley areas has a surface area of from about 0.1 $mm^2$ to about 8 $mm^2$.

All documents cited are, in relevant part, incorporated herein by reference; the citation of any document is not to be construed as an admission that it is prior art with respect to the present invention. All percentages, ratios and proportions are by weight, and all temperatures are in degrees Celsius (°C.), unless otherwise specified. All measurements are in SI units unless otherwise specified.

BRIEF DESCRIPTION OF THE DRAWINGS

The above-mentioned and other features and objects of this invention and the manner of attaining them will become more apparent, and the invention itself will be better understood, by reference to the following description of the invention taken in conjunction with the accompanying drawings, wherein.

DETAILED DESCRIPTION OF THE INVENTION

As used herein the abbreviation "gsm" means "grams per square meter".

As used herein with respect to nonwoven webs or the fibrous substrate preform, the term "machine-direction", or "MD" refers to the direction of web travel as the nonwoven web is produced, for example on commercial nonwoven making equipment. Likewise, the term "cross-direction", or "CD" refers to the direction in the plane of the nonwoven web perpendicular to the machine-direction. With respect to individual wipes, the terms refer to the corresponding directions of the wipe with respect to the web the wipe was made from. These directions are carefully distinguished herein because the mechanical properties of nonwoven webs can differ, depending on how the test sample is oriented during testing. For example, tensile properties of a nonwoven web differ between the machine-direction and the cross-direction, due to the orientation of the constituent fibers, and other process-related factors.

As used herein the term "mesh member" means a mesh or the equivalent of a mesh. One possible "equivalent" would be pattern of repeating solid shapes, such as squares, diamonds, rounded diamonds, and the like, with which are unconnected but act like a mesh in the process and apparatus of the present invention. This and other possible "equivalents" are discussed and explained in more detail herein.

Figure 1:
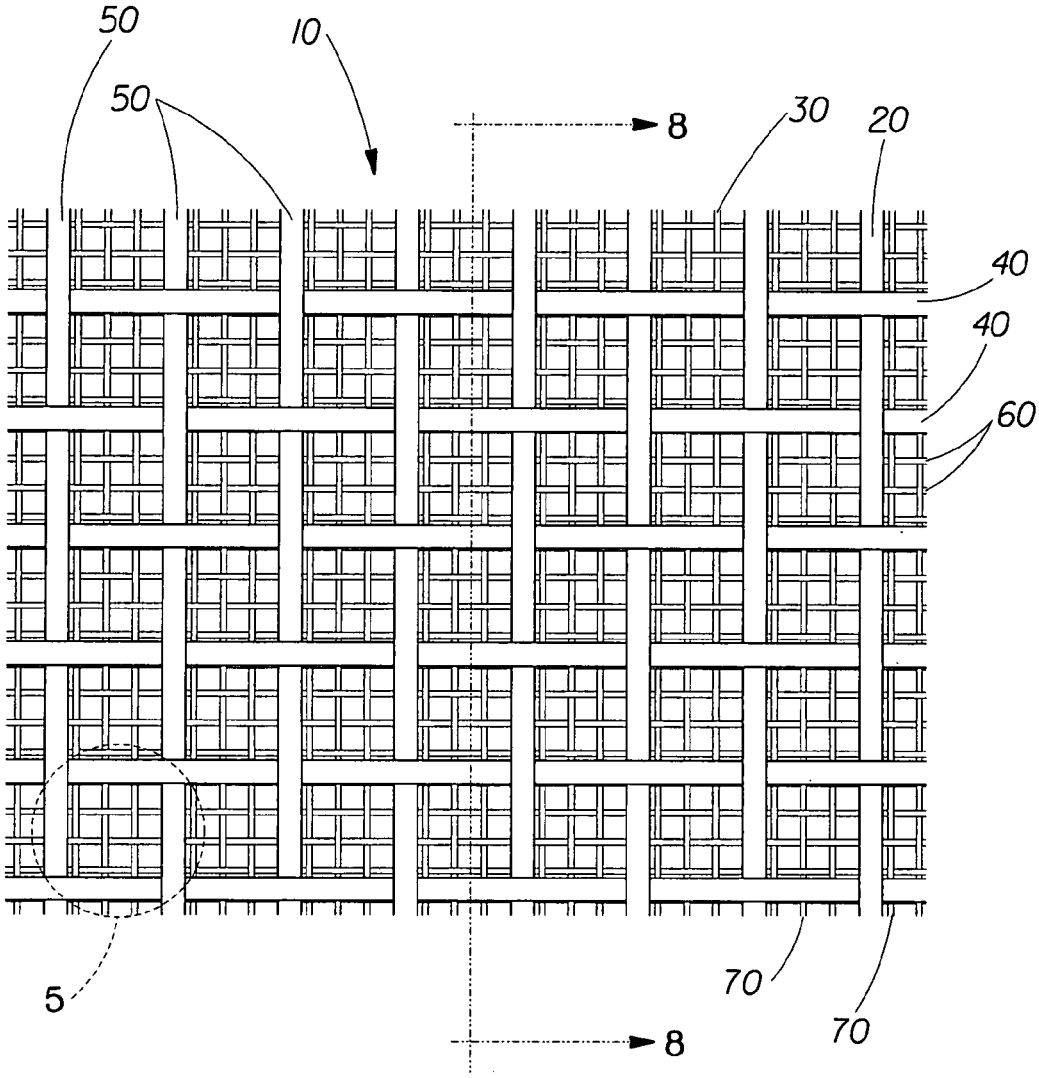
FIG. 1 is an enlarged plan view of one embodiment of the forming screen of the present invention.
Figure 2:
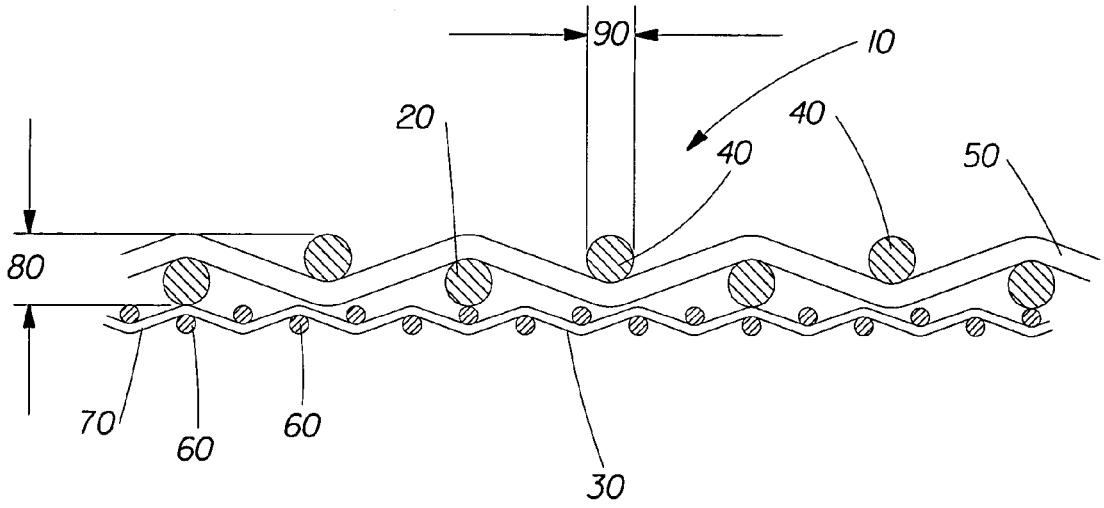
FIG. 2 is a sectional view along 8 of the forming screen of FIG. 1.

Referring to FIGS. 1 and 2, illustrated is one possible embodiment of a forming screen 10, comprising an upper mesh member 20 which comprises interwoven metal wires 40 and 50 and an underlying mesh member 30 which comprises interwoven wires 60 and 70. The wires 40, 50, 60 and 70 may be of an suitable material, including, but not limited to, metal, such as various types of steel, i.e., stainless steel, surgical steel, tool steel; copper, brass, polymers, such as nylon and other suitable polymers and combinations of metals and or polymers. In any event, the material of which the upper mesh member and underlying mesh member are made of must be capable of withstanding the conditions of the present process. The wires may also be of any cross-sectional shape, such as but not limited to, square, circular, elliptical, rectangular, pentagonal, hexagonal, diamond, rounded diamond, dog bone and the like.

Figure 3:
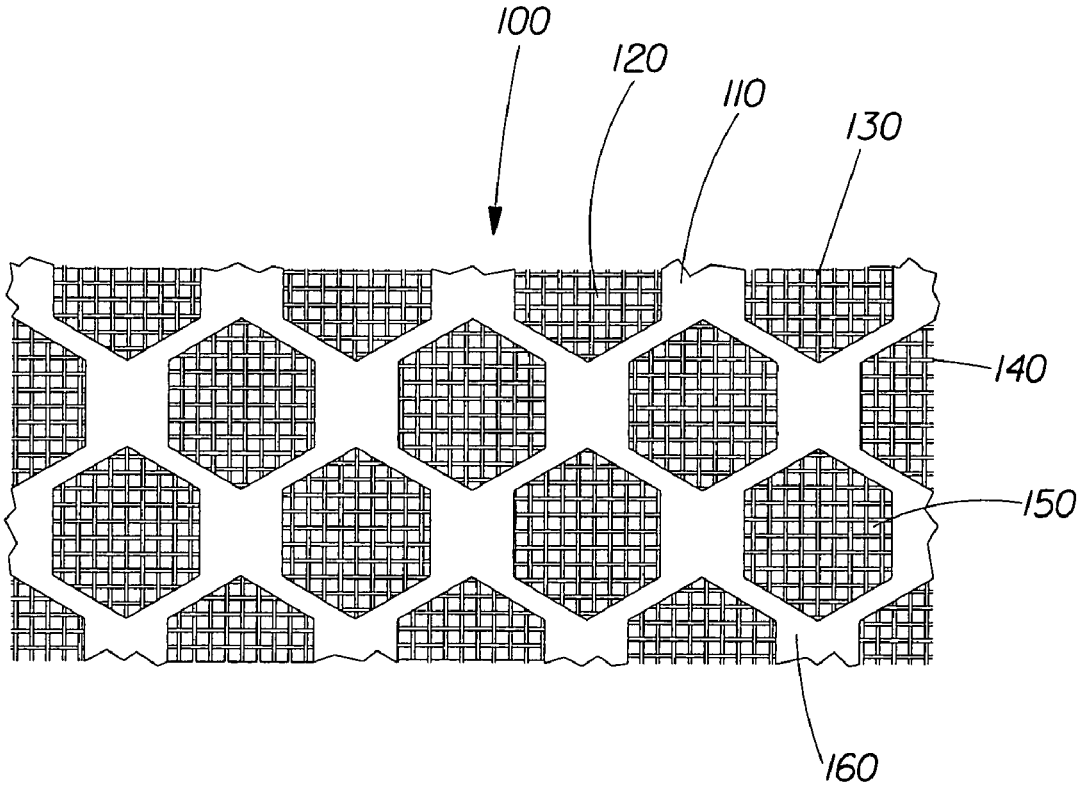
FIG. 3 is an enlarged plan view of another embodiment of the forming screen of the present invention.

The upper mesh member and the underlying mesh member will preferably define a repeating pattern of openings of a particular shape, as can be seen in FIGS. 1 to 3. These openings may be the same or different geometric patterns and are preferably selected from the group consisting of square, circular, elliptical, rectangular, pentagonal, hexagonal, diamond, rounded diamond, dog bone triangular and combinations thereof. Furthermore, these shapes may be uniform or may vary in size shape and orientation.

Turning to FIGS. 1 and 2, both the upper mesh member 20 and the underlying mesh member 30 define the same general type of repeating units of open spaces having a square shape. Whereas in FIG. 3 the upper mesh member 110 define hexagonal shapes and the underlying mesh member 120 defines squares.

The forming screen of the present invention may be may be of any suitable configuration including, but not limited to, a belt, a drum, a cylinder or the like. In one embodiment of the present invention the forming screen is rotatable, such as a rotatable drum or cylinder.

A cross-sectional view of this forming screen 10 along 8 is illustrated in FIG. 2, where it can be seen that the height of the upper mesh member 80 ($h_c$) is measured from the lowest point on the upper mesh member 20 to the highest point. The width of the upper mesh member 90 ($w_c$) is the width of the individual elements, in this case wires, which comprise the upper mesh member 20. The underlying mesh member 30 and the upper mesh member 20 may be permanently joined together or they may be not joined together, but in any case are in intimate contact with one another.

FIG. 3 illustrates another possible embodiment of a forming screen 100, comprising an upper mesh member 110 which comprises a repeating network of open spaces 150 and closed spaces 160 and an underlying mesh member 120 which comprises interwoven metal wires 130 and 140. In this embodiment of the present invention the upper mesh member 110 is permanently attached to the underlying mesh member 120. Additional information on making forming screen 100 where the upper mesh member is a polymer can be found in U.S. Pat. No. 4,637,859 issued on Jan. 20, 1987 to Trokhan and U.S. Pat. No. 5,895,623 issued on Apr. 10, 1999 to Trokhan.

Figure 4:
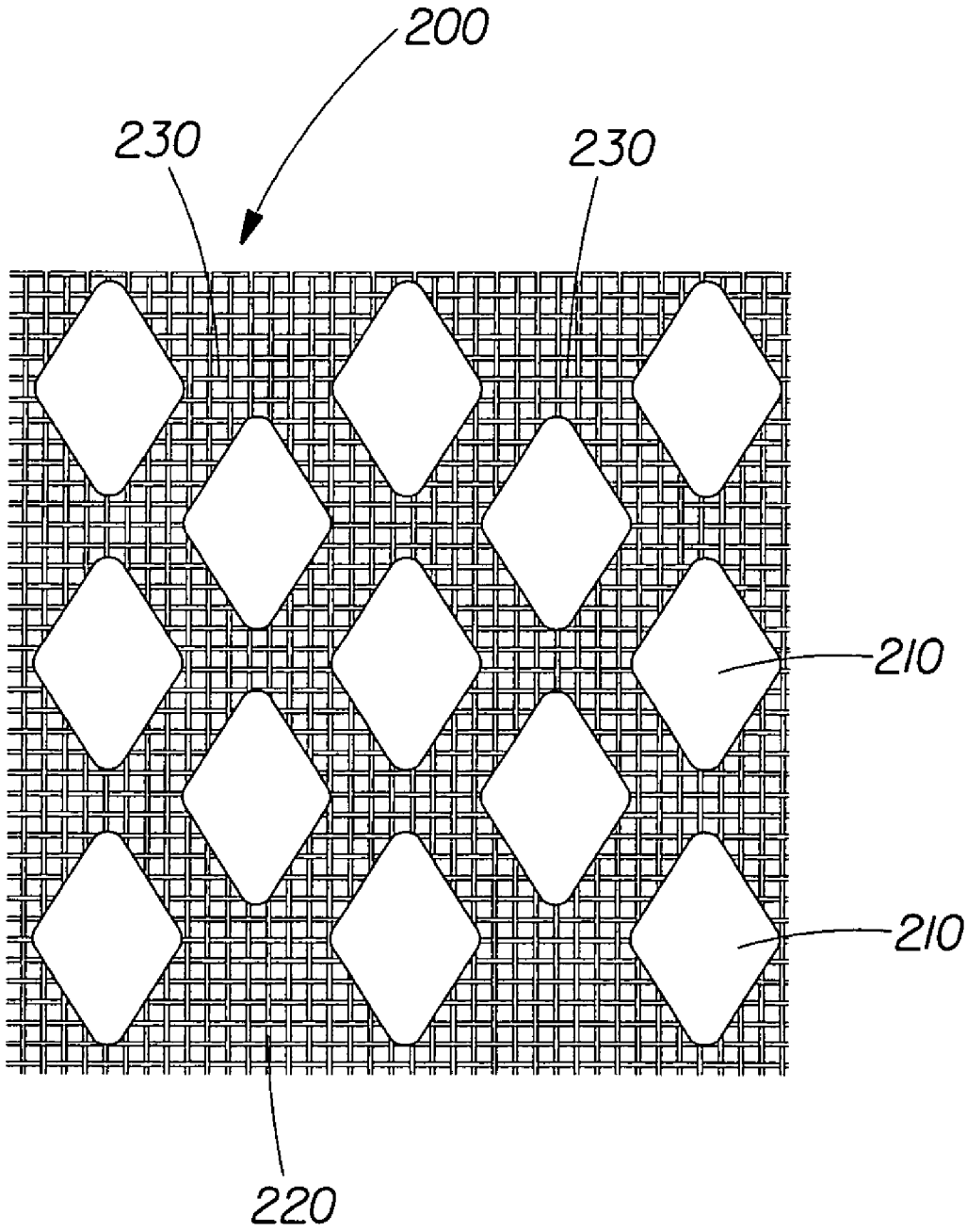
FIG. 4 is an enlarged plan view of another embodiment of the forming screen of the present invention comprising an upper equivalent mesh structure.

FIG. 4 illustrates another alternative embodiment of a forming screen 200, comprising an upper mesh member 210 which comprises a repeating pattern of shapes 210, and an underlying mesh member 220 which comprises interwoven metal wires 230. The shapes may be uniform or may vary in size, shape and orientation, as long as a repeating pattern is present, these three may all be varied in any fashion. In this alternative embodiment of the present invention the upper mesh member 210 which form the equivalent of a mesh is permanently attached to the underlying mesh member 220. Additional information on making forming screen 200 where the upper mesh member 210 is permanently attached to the underlying mesh member 220 can be found in U.S. Pat. No. 4,637,859 issued on Jan. 20, 1987 to Trokhan; U.S. Pat. No. 5,895,623 issued on Apr. 10, 1999 to Trokhan; U.S. Pat. No. 4,514,345 issued on Apr. 30, 1985 to Johnson; U.S. Pat. No. 5,098,522 issued on Mar. 24, 1992 to Smurkoski; U.S. Pat.

No. 4,528,239 issued on Jul. 9, 1985 to Trokhan; and U.S. Pat. No. 5,245,025 issued on Sep. 14, 1993 to Trokhan.

Figure 5:
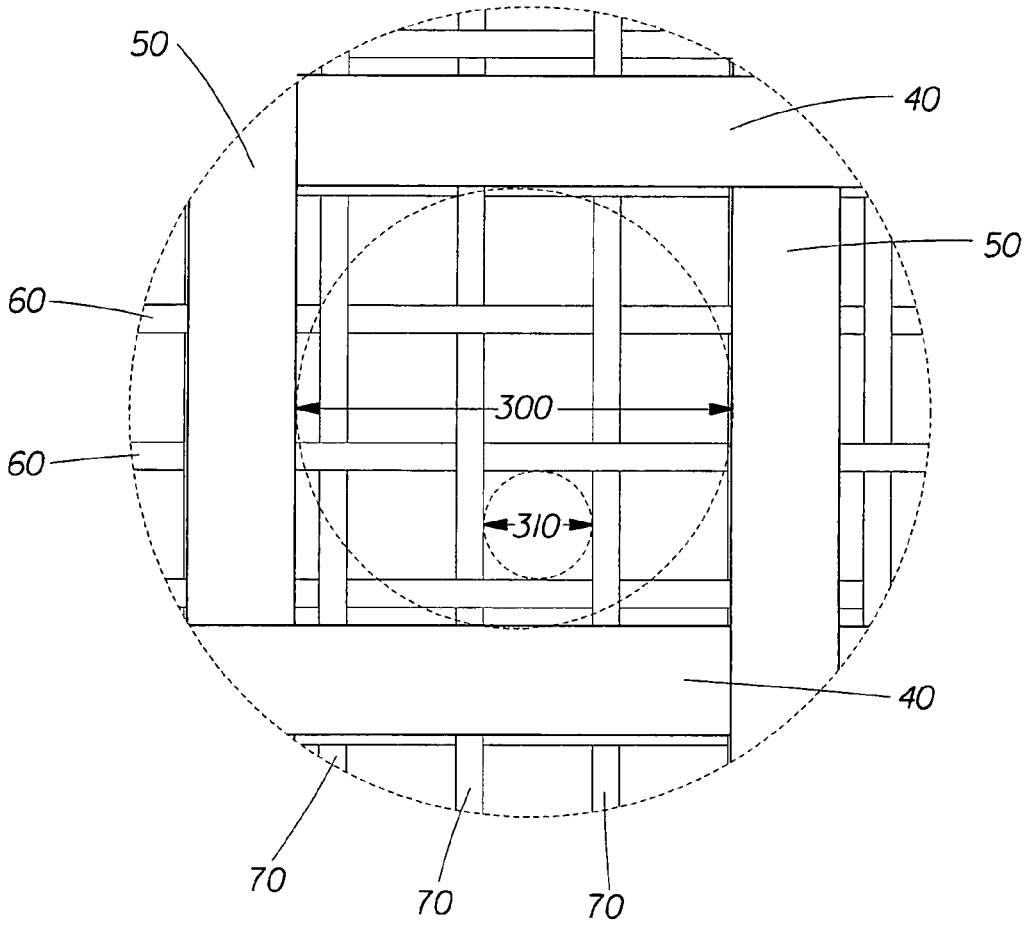
FIG. 5 is an enlarged view of area 95 of the forming screen of FIG. 1.

FIG. 5 is an exploded view of one of the repeating sections of the upper mesh member 20 of the forming screen 10 of FIG. 1. FIG. 5 shows the effective diameter of the upper mesh member 300 ($d_c$) of the forming screen 10 of FIG. 1. The effective diameter of the upper mesh member 300 is the diameter of the largest circle which can be drawn within the area of the interwoven metal wires 40 and 50. FIG. 5 also illustrates the effective diameter of the underlying mesh member 310 ($d_f$) of the forming screen 10 of FIG. 1. The effective diameter of the upper mesh member 310 is the diameter of the largest circle which can be drawn within the area of the interwoven metal wires 60 and 70. For forming screens similar those illustrated in FIG. 4 which form the equivalent of a mesh, the effective diameter of the upper mesh member, or $d_c$, is the diameter of the largest circle which can be drawn within the area of any of the shapes of the repeating pattern of shapes 210. In one optional embodiment of the present invention $d_c^2/d_f^2$ is greater than or equal to about 50 and is less than or equal to about 300.

The fibrous substrate preform can be formed in any conventional fashion, but is preferably any nonwoven web which is suitable for use in a hydroentangling process. The fibrous substrate preform may consist of any web, mat, or batt of loose fibers, disposed in random relationship with one another or in any degree of alignment, such as might be produced by carding, air-laying and the like.

Carding is a mechanical process whereby clumps of fibers are separated into individual fibers and simultaneously made into a coherent web. Carding is typically carried out on a machine that utilizes opposed moving beds or surfaces of fine, angled, closely spaced teeth or wires or their equivalent to pull and tease the clumps apart. The teeth of the two opposing surfaces typically are inclined in opposite directions and move at different speeds relative to each other.

Air-laying, on the other hand, is a process whereby air is used to separate, move, and randomly deposit fibers from a forming head to form a coherent, and largely isotropic web. Air laying equipment and processes are known in the art, and include Kroyer or Dan Web devices (suitable for wood pulp air laying, for example) and Rando webber devices (suitable for staple fiber air laying, for example).

The fibers of the fibrous substrate preform, and subsequently the molded, textured, spunlaced, nonwoven web, can be any natural, cellulosic, and/or wholly synthetic material. Suitable natural fibers include but are not limited to cellulosic fibers, such as wood pulp fibers, cotton, rayon (also known as viscose) and combinations there of. Suitable synthetic fibers include fibers commonly used in textiles, including but not limited to polyester, polyolefins, such as polypropylene, and combinations of synthetic fibers. The fibers of the fibrous substrate preform, and subsequently the molded, textured, spunlaced, nonwoven web, can be a combination of natural and synthetic fibers. In one embodiment viscose (rayon) is used in combination with polypropylene for an economical balance of softness and bondability (in embossing). The viscose provides excellent softness and cloth like properties, which when used alone tends to produce a flannel-like web. Polypropylene permits the web to be thermally bonded in an optional embossing step.

The fibers of the fibrous substrate preform, and subsequently the molded, textured, spunlaced, nonwoven web, can be of virtually any size and preferably have an average length from about 10 mm to about 60 mm. Average fiber length refers to the length of the individual fibers if straightened out. In any event, in the process of the instant invention the average fiber length, or $f_l$, must be greater than the height of upper mesh member ($h_c$).

The fibers of the fibrous substrate preform, and subsequently the molded, textured, spunlaced, nonwoven web, can be circular in cross-section, dog bone shaped, delta (i.e., triangular cross-section), tri-lobal, ribbon, or other shapes typically produced as staple fibers. Likewise, the fibers can be conjugate fibers, such as bicomponent fibers. The fibers may be crimped, and may have a finish, such as a lubricant, applied.

The fibrous substrate preform of the present invention will preferably have a basis weight of between about 15 gsm and about 100 gsm, more preferably between about 30 gsm and about 75 gsm, even more preferably between about 40 gsm and about 65 gsm. One suitable fibrous substrate preform for use in the present invention is available from the J.W. Suominen Company of Finland, and sold under the FIBRELLA trade name, for example, FIBRELLA 3100 and FIBRELLA 3160 have been found to be useful as the fibrous substrate preform of the present invention. FIBRELLA 3100 is a 62 gsm nonwoven web comprising 50% 1.5 denier polypropylene fibers and 50% 1.5 denier viscose fibers. FIBRELLA 3160 is a 58 gsm nonwoven web comprising 60% 1.5 denier polypropylene fibers and 40% 1.5 denier viscose fibers. In both of these commercially available fibrous substrate preform, the average fiber length is about 38 mm.

The process of the present invention involves subjecting the fibrous substrate preform to a hydroentanglement process while the fibrous substrate preform is in contact with the forming screen. The hydroentanglement process (also known as spunlacing or spunbonding) is a known process of producing nonwoven webs, and involves laying down a matrix of fibers, for example as a carded web or an air-laid web, and entangling the fibers to form a coherent web. Entangling is typically accomplished by impinging the matrix of fibers with high pressure water from preferably at least one, more preferably at least two, even more preferably a plurality of suitably-placed water jets, often referred to as hydroentangling. The water pressure of the water jets as well as the orifice size and the energy imparted to the fibrous substrate preform by the water jets are the same as those of a conventional hydroentangling process, typically entanglement energy is at about 0.1 kwh/kg. While other fluids can be used as the impinging medium, such as compressed air, water is the preferred medium. The fibers of the web are thus entangled, but not physically bonded one to another. The fibers of a hydroentangled web, therefore, have more freedom of movement than fibers of webs formed by thermal or chemical bonding. Particularly when lubricated by wetting as a pre-moistened wet wipe, such spunlaced webs provide webs having very low bending torques and low moduli, thereby maintaining the softness and suppleness.

Additional information on hydroentanglement can be found in U.S. Pat. No. 3,485,706 issued on Dec. 23, 1969, to Evans; U.S. Pat. No. 3,800,364 issued on Apr. 2, 1974, to Kalwaites; U.S. Pat. No. 3,917,785 issued on Nov. 4, 1975, to Kalwaites; U.S. Pat. No. 4,379,799 issued on Apr. 12, 1983, to Holmes; U.S. Pat. No. 4,665,597 issued on May 19, 1987, to Suzuki; U.S. Pat. No. 4,718,152 issued on Jan. 12, 1988, to Suzuki; U.S. Pat. No. 4,868,958 issued on Sep. 26, 1989, to Suzuki; U.S. Pat. No. 5,115,544 issued on May 26, 1992, to Widen; and U.S. Pat. No. 6,361,784 issued on Mar. 26 2002, to Brennan.

In the present invention conducting the hydroentanglement process concurrently with the fibrous substrate preform contacting the forming screen produces a molded, textured, spunlaced nonwoven web which has an increase in both the wet and dry thickness of the molded, textured, spunlaced, nonwoven web over a hydroentangled web of the same basis weight which has not been treated by the process of the present invention. It is preferred that this increase in both the wet and dry thickness be preferably at least about 5%, more preferably at least about 10%, and even more preferably about 15% in both the wet and dry thickness of the molded, textured, spunlaced, nonwoven web over a hydroentangled web of the same basis weight which has not been treated by the process of the present invention. Furthermore, this increased thickness and texture do not increase the amount of entanglement energy (the energy transferred to the web by the water jets) needed to produce the molded, textured, spunlaced, nonwoven web over a conventional hydroentangled web.

One alternative embodiment of the present invention is a molded, textured, spunlaced nonwoven web which is substantially free, preferably totally free, of apertures. This lack of apertures is especially desired when the molded, textured, spunlaced, nonwoven web of the present invention is used in a remoistened wipe, as explained in more detail herein.

In another optional embodiment the fibrous substrate preform is subjected to a separate hydroentanglement process prior to it contacting the forming screen herein. This additional and optional process step may be used to impart additional strength to the fibrous substrate preform, and subsequently to the molded, textured, spunlaced, nonwoven web. In one preferred embodiment of this optional embodiment the fibrous substrate preform is subjected to a hydroentanglement process which involves impinging the fibrous substrate preform with high pressure water from a plurality of suitably-placed water jets using a conventional forming screen (approximately 100 mesh wire) then turning the fibrous substrate preform over and subjecting the other side to a plurality of suitably-placed water jets. This two-part "pre-hydroentangling" provides additional strength, stability and softness to the fibrous substrate preform, (and subsequently the molded, textured, spunlaced, nonwoven web) prior to the fibrous substrate preform contacting the forming screen such as shown in FIG. 1, 3 or 4 for the final molding/texturing step described herein.

Unexpectedly, after the molded, textured, spunlaced, nonwoven web has been formed, it can be effectively subjected to additional optional process steps, such as, embossing. By embossing the molded, textured, spunlaced, nonwoven web, it can gain additional aesthetics, making the molded, textured, spunlaced, nonwoven web particularly suitable for use as a wet wipe. Moreover, besides better aesthetics, other beneficial physical characteristics are imparted to the molded, textured, spunlaced, nonwoven web by embossing. For example, by embossing the molded, textured, spunlaced, nonwoven web at sufficiently elevated temperatures additional thermal bonding is achieved in the compressed regions, thereby giving better surface fiber bonding. This surface fiber bonding "ties down" loose fiber, resulting in reduced linting of the molded, textured, spunlaced, nonwoven web. Additionally the thermal bonding of the embossing operation increases the strength of the molded, textured, spunlaced, nonwoven web, especially when used in a wet wipe application. The added embossing contributes to reducing the available CD stretch of the molded, textured, spunlaced, nonwoven web. Excessive CD stretch is often a characteristic of carded webs, and is generally undesirable in a wet wipe. By reducing CD stretch, the stretch properties of the molded, textured, spunlaced, nonwoven web are more uniform, and more suited for use as a wet wipe.

The molded, textured, spunlaced, nonwoven web of the present invention which can be used to make pre-moistened wipes, which can also be referred to as "wet wipes" "wipes" and "towelettes", are suitable for use in cleaning babies, and can also find use in cleaning tasks related to persons of all ages. Such wipes can also include articles used for application of substances to the body, including but not limited to application of make-up, skin conditioners, ointments, sun-screens, insect repellents, and medications. Such wipes can also include such articles used for cleaning or grooming of pets, and articles used for general cleansing of surfaces and objects, such as household kitchen and bathroom surfaces, eyeglasses, exercise and athletic equipment, automotive surfaces, and the like. These wipes contain the molded, textured, spunlaced, nonwoven web and a composition of matter releasably combined therewith. The manufacture of compositions suitable for application via wipes are well known and form no part of this invention. Examples of compositions and/or ingredients which can be releasably combined with the molded, textured, spunlaced, nonwoven web of the present invention to make wet wipes can be found in U.S. Pat. No. 6,300,301 issued on Oct. 9, 2001, to Moore; U.S. Pat. No. 6,361,784 issued on Mar. 26, 2002, to Brennan; U.S. Pat. No. 6,083,854 issued on Jul. 4, 2000, to Bogdanski; U.S. Pat. No. 5,648,083 issued on Jul. 15, 1997, to Blieszner; U.S. Pat. No. 5,043,155 issued on Jul. 15, 1997, to Puchalski; U.S. Pat. No. 6,207,596 issued on Mar. 27, 2001, to Rourke; U.S. Pat. No. 5,888,524 issued on Mar. 30, 1999, to Cole; U.S. Pat. No. 5,871,763 issued on Feb. 16, 1999, to Luu; U.S. Pat. No. 4,741,944 issued on May 3, 1988, to Jackson; U.S. Pat. No. 3,786,615 issued on Jan. 22, 1974, to Bauer; and U.S. Pat. No. 6,440,437 issued on Jan. 22, 1974, to Krzysik, and various formulas.

Wipes containing the molded, textured, spunlaced, nonwoven web of the present invention are particularly suitable for dispensing from a tub of stacked, folded wipes. They are also suited for dispensing as "pop-up" wipes, in which upon pulling a wipe out of the tub, an edge of the next wipe is presented for easy dispensing. The wipes can be folded in any of various known folding patterns, such as C-folding, but is preferably Z-folded. A Z-folded configuration enables a folded stack of wipes to be interleaved with overlapping portions. Exemplary fold patterns are disclosed more fully in, U.S. Pat. No. 6,213,344, issued on Apr. 10, 2001, to Hill; U.S. Pat. No. 6,202,845, issued on Mar. 20, 2001, to Hill; U.S. Pat. No. 5,332,118, issued on Jul. 26, 1994, to Muckenfuhs; U.S. Pat. No. 6,030,331, issued on Feb. 29, 2000 to Zander; U.S. Pat. No. 5,964,351, issued on Oct. 12, 1999, to Zander; and U.S. Pat. No. 5,540,332, issued on Jul. 30, 1996, to Kopacz. Alternatively, the molded, textured, spunlaced, nonwoven web may be folded in an alternating configuration, such as an alternating pattern of Z-fold and C-folds. An example of this alternating fold pattern can be found in U.S. Pat. No. 6,250,495 issued on Jun. 26, 2001, to Bando.

It is preferred that the wipes comprising the molded, textured, spunlaced, nonwoven web of the present invention releasably contain from about 0.1 to about 10, more preferably from about 1 to about 8, even more preferably from about 2 to about 5 grams of composition of matter per gram of molded, textured, spunlaced, nonwoven web.

Figure 6:
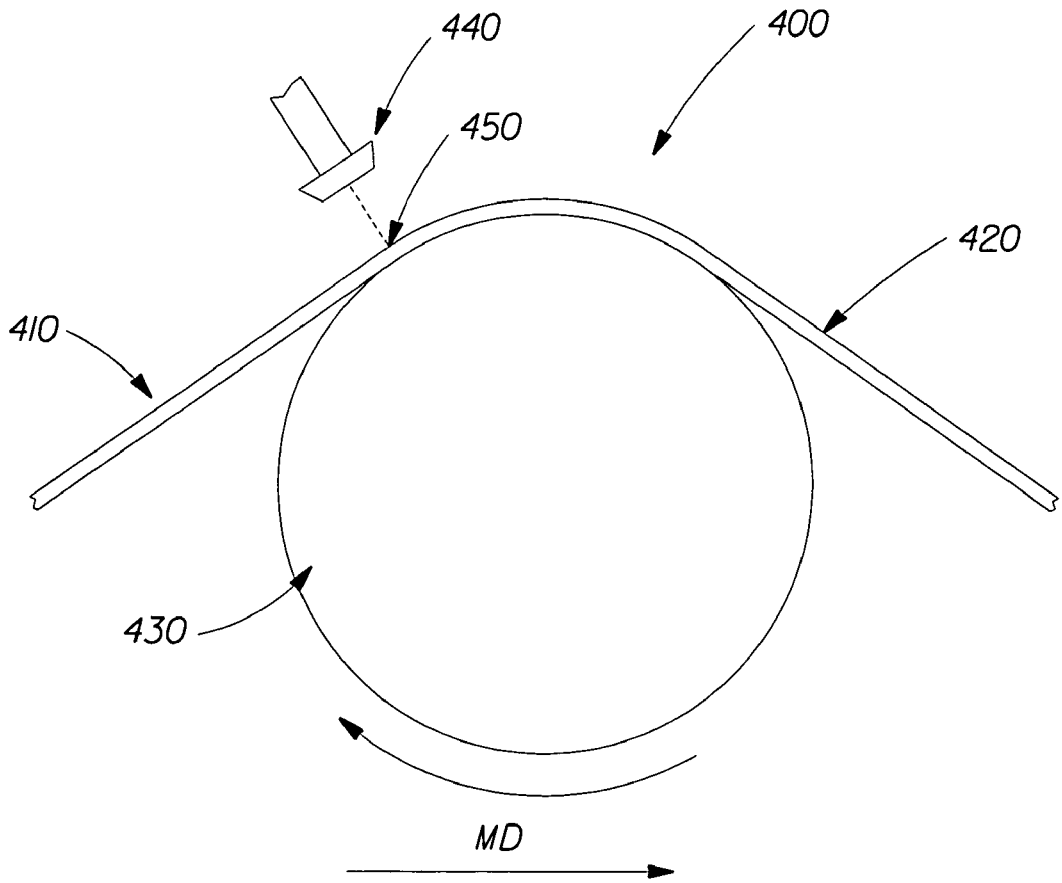
FIG. 6 is side view of one embodiment of an apparatus of the present invention.

FIG. 6 is an illustration of one possible apparatus of the present invention. The apparatus 400 for forming molded, textured, spunlaced, nonwoven web 420 comprises the forming screen 430, and a hydroentanglement means 440. In FIG. 6 the hydroentanglement means 440 is represented as a single water jet, however it is within the scope of the present invention to use multiple water jets as the hydroentanglement means and also optionally to include a vacuum means, to aid in the removal of the water once it has contacted the fibrous substrate preform 410 at juncture 450 to produce the molded, textured, spunlaced, nonwoven web 420. The apparatus for forming molded, textured, spunlaced, nonwoven web 400 may optionally comprise a support means, typically a perforated drum or cylinder, on which the forming screen 430 is placed. The use of an optional support means allows for removal and replacement of the forming screen 430 when necessary for maintenance and/or repair of the apparatus 400, or for replacement of worn forming screen 430, or replacement of forming screen 430 with a forming screen which produces a molded, textured, spunlaced, nonwoven web with a different mold texture.

The fibrous substrate preform 410 may be treated in any of the ways disclosed herein prior to contacting the forming screen 430. Similarly, the molded, textured, spunlaced, nonwoven web 420 may be treated in any of the ways disclosed herein subsequent to its formation at 450 on the forming screen 430.

Figure 7:
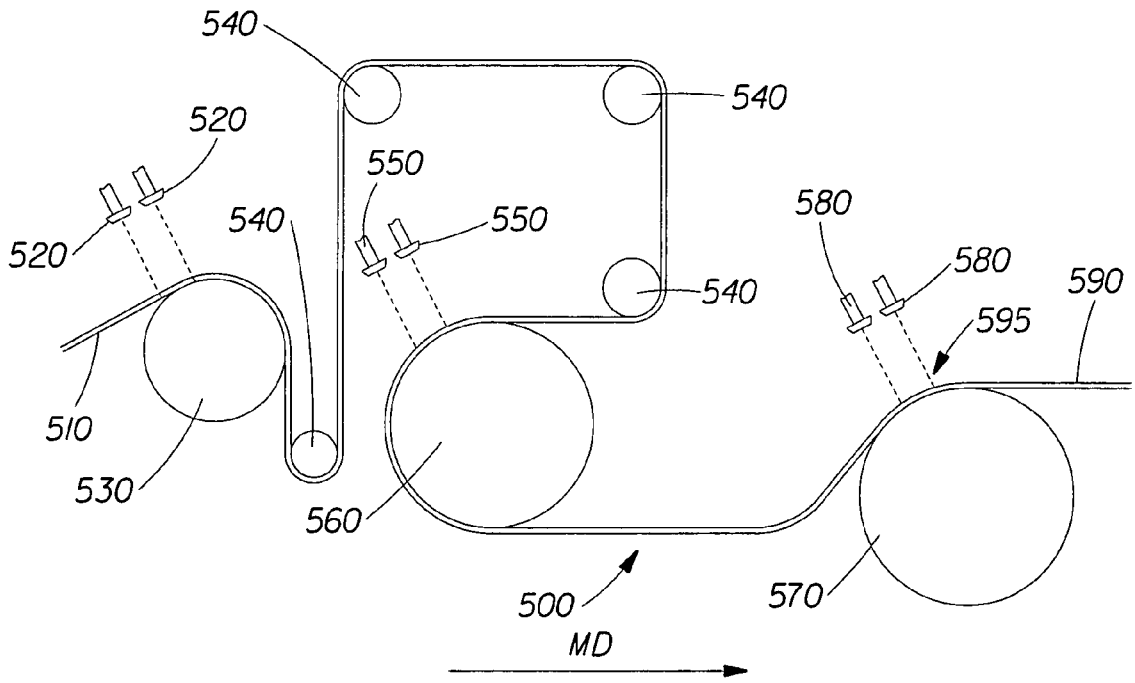
FIG. 7 is side view of another embodiment of an apparatus of the present invention.

FIG. 7 illustrates another possible apparatus of the present invention. The apparatus 500 for forming molded, textured, spunlaced, nonwoven web 590 comprises a first drum 530 on to which the fibrous substrate preform 510 moves on to and is entangled by hydroentanglement means 520. The first drum 530, and second drum 560, may be any drum suitable for use in a hydroentanglement processes, such as a perforated drum, a vacuum drum etc. Most suitable are drums which are used in conventional hydroentanglement processes and are discussed in the U.S. patents referred to herein for their teaching on hydroentanglement. The hydroentanglement means 520 is shown with two jets of water; however it is within the scope of the present invention to use single water jets or multiple water jet as the hydroentanglement means 520, or for any of the hydroentanglement means of the present invention. As noted a vacuum means can optionally be used as part of the hydroentanglement means 520 or for any of the hydroentanglement means of the present invention. The vacuum means aids in removal of the water once it has contacted the fibrous substrate preform 510.

The fibrous substrate preform 510 then moves over various rollers in the apparatus, identified as 540, so that the surface of the fibrous substrate preform 510 which contacts with the second drum 560 is the opposing surface to the surface which contacted first drum 530. This alternating of entanglement, while not wishing to be limited in theory, is believed to improve the overall strength of the fibrous substrate preform 510. The fibrous substrate preform 510 moving on the second drum 560 is then entangled by hydroentanglement means 550. The fibrous substrate preform 510 then moves on to the forming screen 570, and is contacted with water form the hydroentanglement means 580 at juncture 595 thereby forming the molded, textured, spunlaced, nonwoven web 590 of the present invention.

In both the apparatus and process of the present invention it is preferred that any hydroentanglement means comprise at least one jet of water which is approximately perpendicular to the forming screen. However, while it is not preferred, it is still within the scope of the present invention to have a hydroentanglement means comprising at least one jet of water which is other than approximately perpendicular to the forming screen. Angles within 30° of perpendicular are useful.

The forming screens of the apparatus of the present invention may be any suitable forming screens. Examples of such suitable forming screens are illustrated herein in FIGS. 1 to 5 inclusive. Other forming screens are suitable for use in the present invention provided that the forming screen's $d_c^2/d_f^2$ is greater than or equal to about 50 and is less than or equal to about 300.

Other optional post treatment of the molded, textured, spunlaced, nonwoven web, include but are not limited to, drying of the molded, textured, spunlaced, nonwoven web; addition of a composition of matter to the molded, textured, spunlaced, nonwoven web; rolling of the molded, textured, spunlaced, nonwoven web on to a roll for storage and the like; cutting of the molded, textured, spunlaced, nonwoven web into shorter lengths; folding the molded, textured, spunlaced, nonwoven web, especially when the molded, textured, spunlaced, nonwoven web has been cut into smaller lengths, into various configurations such as C-folding, Z-folded and the like; and combinations thereof.

In accordance with another aspect of the present invention a molded, textured, spunlaced, nonwoven web is provided. This molded, textured, spunlaced, nonwoven web may optionally be prepared by process or the apparatus of the present invention. Furthermore, this molded, textured, spunlaced, nonwoven web may be optionally post treated, such as addition of a composition of matter, embossing, cutting to a specific length and/or folded, or by other various post treatments detailed herein.

The molded, textured, spunlaced, nonwoven web of the present invention will preferably have a basis weight of between about 15 gsm and about 100 gsm, more preferably between about 30 gsm and about 75 gsm, even more preferably between about 40 gsm and about 65 gsm.

In one optional embodiment of the present invention the molded, textured, spunlaced, nonwoven web comprises a fibers which have an average fiber length of from about 20 mm to about 45 mm, more preferably from about 30 mm to about 40 mm and a diameter of from about 1 denier to about 2 denier, more preferably from about 1.2 denier to about 1.75 denier.

Figure 8:
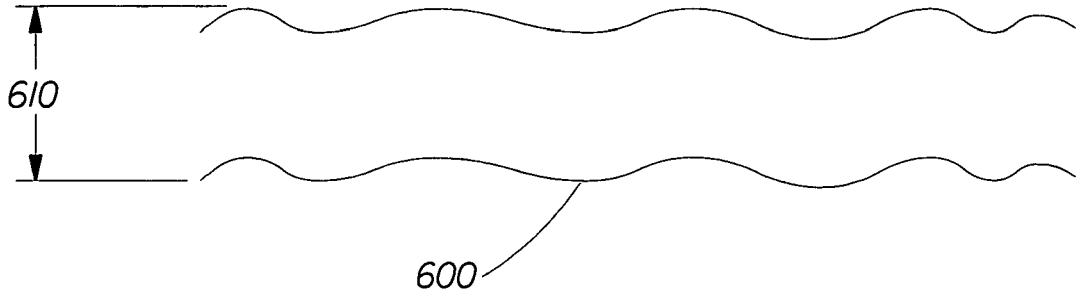
FIG. 8 is an idealized side view of a conventionally hydroentangled nonwoven web not according to the present invention.
Figure 9:
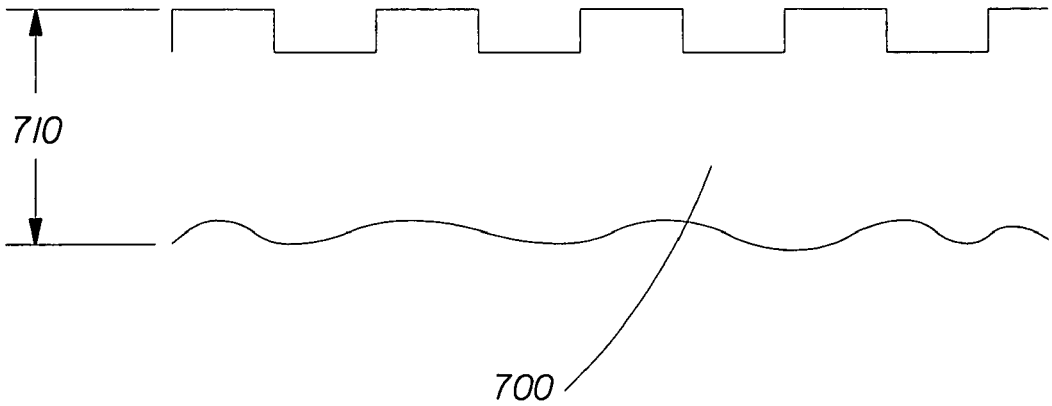
FIG. 9 is an idealized side view of molded, textured, spunlaced, nonwoven web of the present invention.

FIG. 8 illustrates an idealized side view of a hydroentangled nonwoven web 600 whereas FIG. 9 illustrates an idealized side view of a molded, textured, spunlaced, nonwoven web 700 of the present invention having the same basis weight as the conventionally hydroentangled nonwoven web 600. The thickness of the hydroentangled nonwoven web ($T_{um}$) 610 is the maximum thickness of the hydroentangled nonwoven web 600. The thickness of the molded, textured, spunlaced, nonwoven web ($T_m$) 710 is the maximum thickness of the molded, textured, spunlaced, nonwoven web 700.

In one optional embodiment of the present invention it is preferred that the height of the upper mesh member ($h_c$) be greater than zero and less than or equal to $T_{um}$.

In another optional embodiment of the present invention it is preferred that the effective open diameter of an upper mesh member ($d_c$) wherein $d_c/T_{um}$ is greater than or equal to 1 and is less than or equal to 4.

Figure 10:
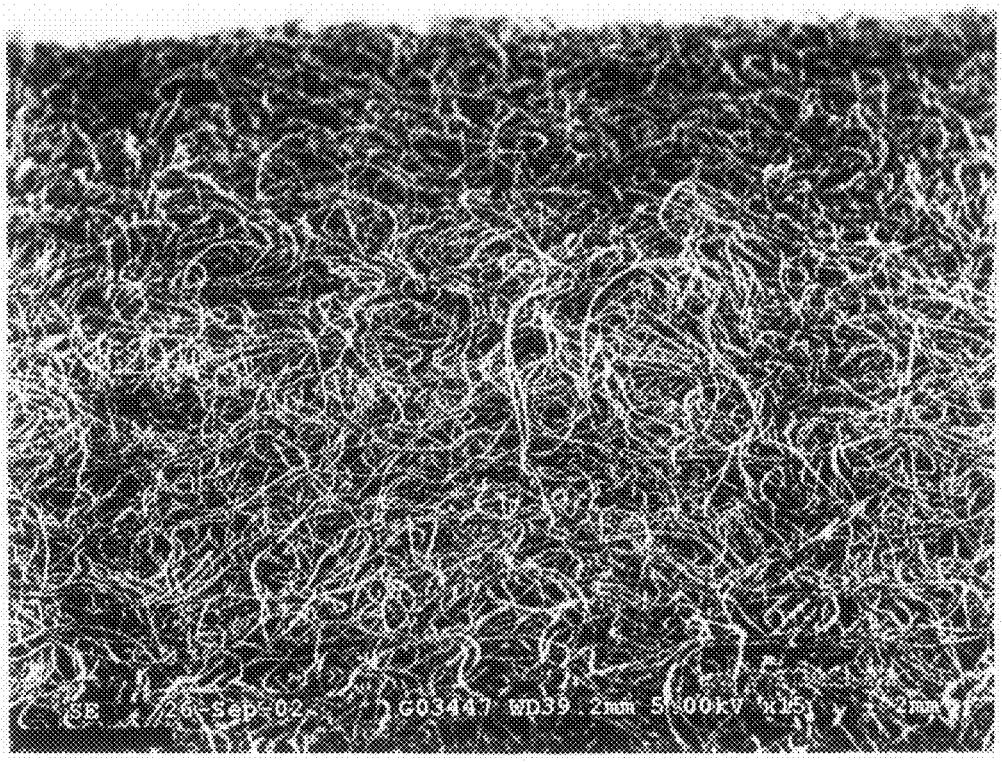
FIG. 10 is a photograph of a conventionally hydroentangled nonwoven web not according to the present invention.
Figure 11:
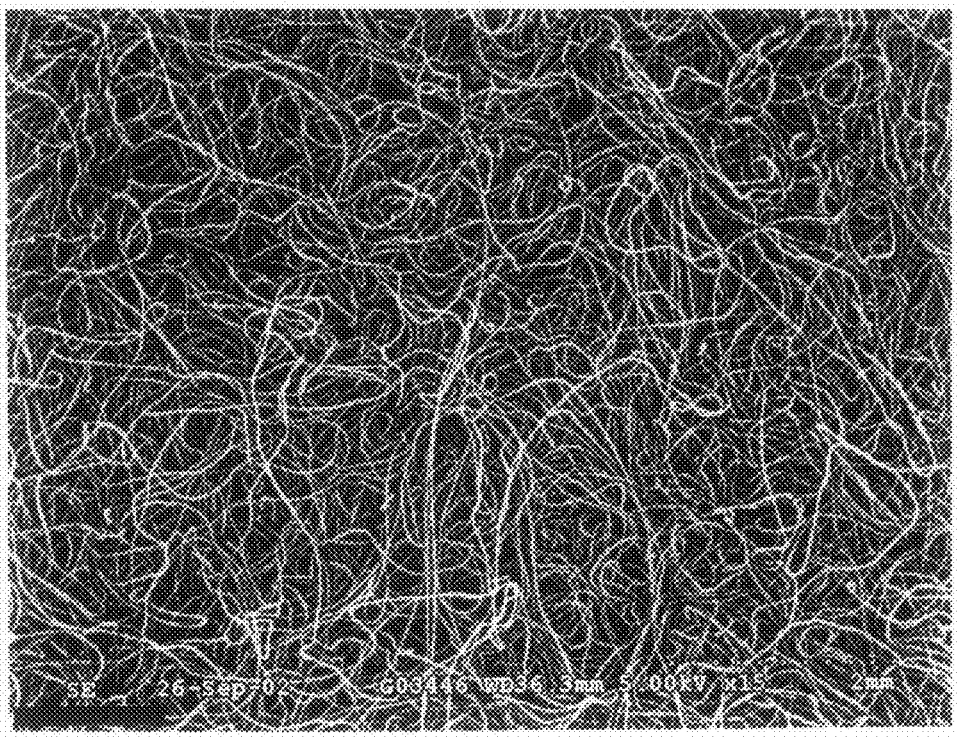
FIG. 11 is an electron microscope photograph of the conventionally hydroentangled nonwoven web of FIG. 10.
Figure 12:
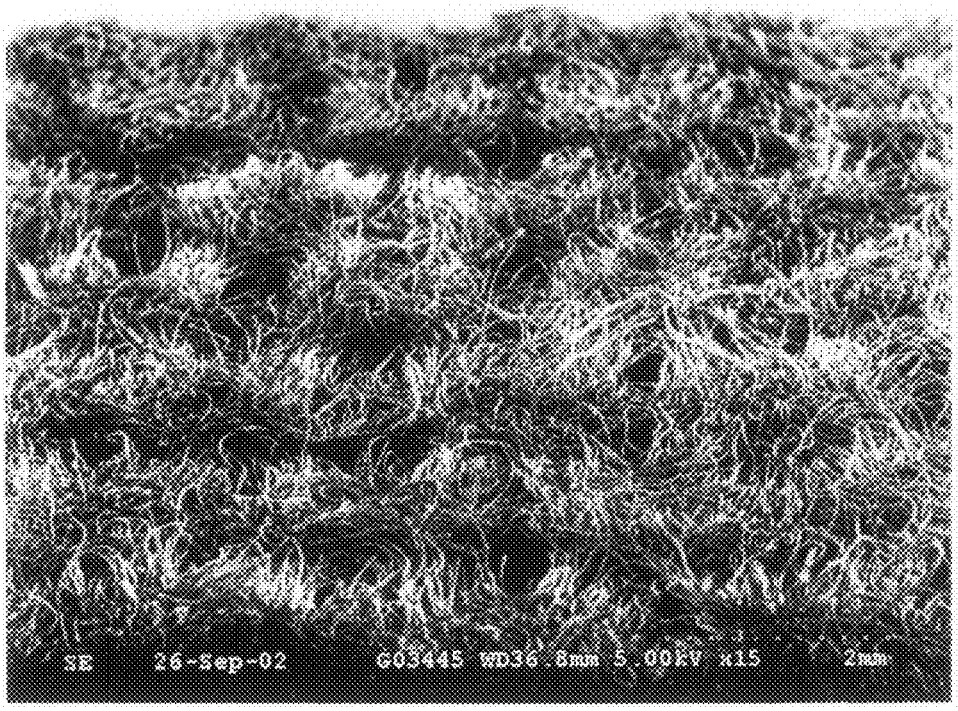
FIG. 12 is a photograph of an apertured conventionally hydroentangled nonwoven web not according to the present invention.
Figure 13:
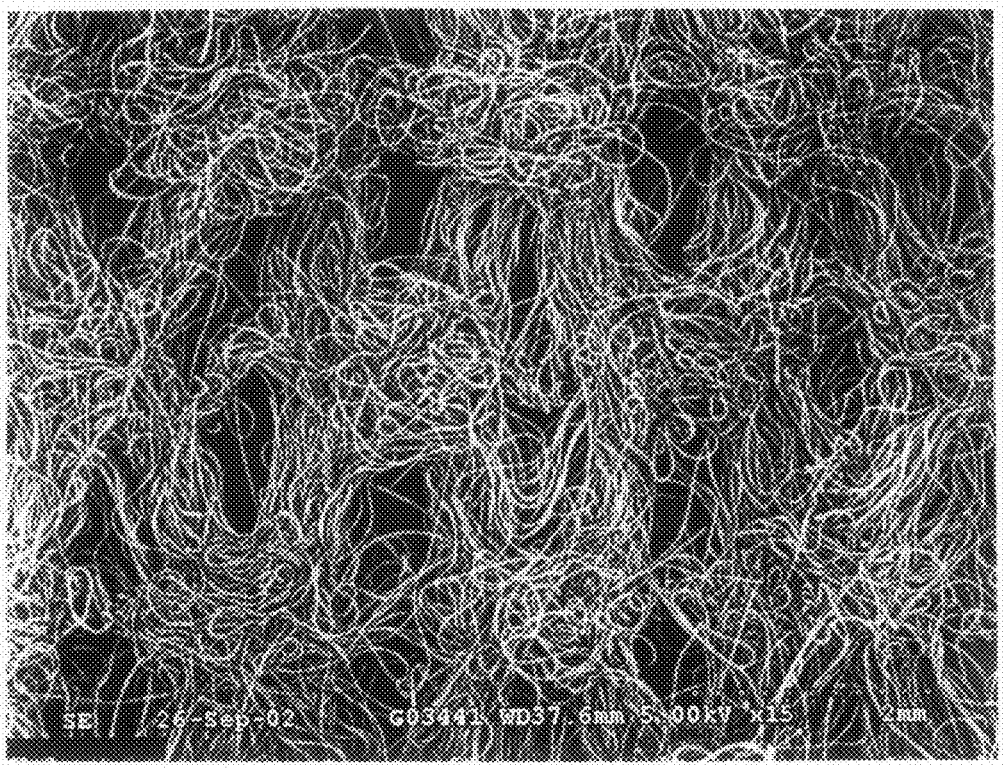
FIG. 13 is an electron microscope photograph of the apertured conventionally hydroentangled nonwoven web of FIG. 12.
Figure 14:
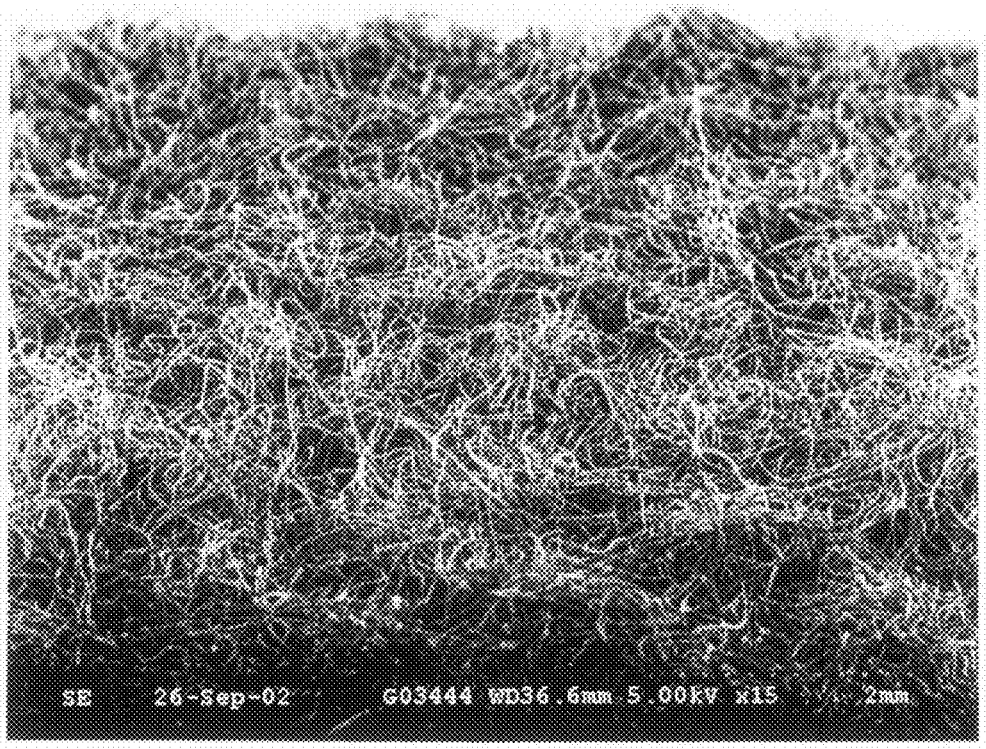
FIG. 14 is a photograph of a molded, textured, spunlaced, nonwoven web of the present invention.
Figure 15:
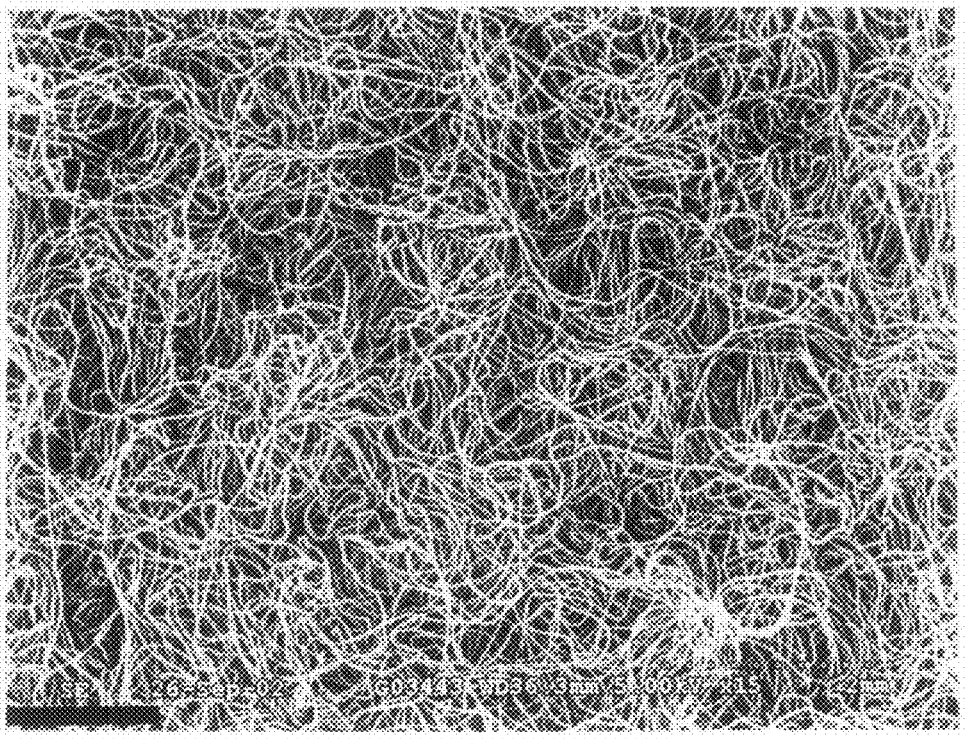
FIG. 15 is an electron microscope photograph of the molded, textured, spunlaced, nonwoven web of FIG. 14.

FIGS. 10 and 11 illustrate the lack of texture and molding in the structure of a conventional hydroentangled web. The web in FIGS. 10 and 11 has all the problems associated with conventional hydroentangled web identified herein. FIGS. 12 and 13 show an apertured conventional hydroentangled web, which has the additional disadvantage of making it unsuitable for certain applications, such as wet wipes, in particular baby wipes and the like. Contrast these two conventionally hydroentangled webs with the molded, textured, spunlaced, nonwoven web of the present invention as illustrated in FIGS. 14 and 15. The texture and molding shown in FIGS. 14 and 15 is in stark contrast with the lack of texture and/or molding in the conventional hydroentangled web, as illustrated in FIGS. 10 and 11. Furthermore, the molded, textured, spunlaced, nonwoven web of the present invention as illustrated in FIGS. 14 and 15 has an added advantage over the conventional hydroentangled web, as illustrated in FIGS. 12 and 13, of providing texture and molding without apertures.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for forming a molded, textured, spunlaced, nonwoven web from a fibrous substrate preform comprising the steps of:

contacting the fibrous substrate preform with at least one jet of water prior to the fibrous substrate preform contacting a forming screen, wherein the at least one jet of water is directed on to the fibrous substrate preform approximately perpendicular to the fibrous substrate perform;

placing the fibrous substrate preform in contact with the forming screen, the forming screen comprising an upper mesh member having a height, $h_c$ and an underlying mesh member in direct contact with the upper mesh member, while concurrently subjecting the fibrous substrate preform to a hydroentanglement process, the fibrous substrate preform having an average fiber length, $f_l$ and wherein $f_l$ is greater than $h_c$, and wherein the fibrous substrate preform is selected from the group consisting of carded substrate preform and airlaid substrate preform.

2. The process according to claim 1, wherein the upper mesh member has an effective open diameter, $d_c$ and the underlying mesh member has an effective open diameter, $d_f$, and wherein $d_c^2/d_f^2$ is greater than or equal to about 50 and is less than or equal to about 300.

3. The process according to claim 1, wherein the forming screen is a rotatable cylinder.

4. The process according to claim 1, wherein the hydroentanglement process comprises contacting the fibrous substrate preform with at least one jet of water, wherein the at least one jet of water is directed on to the fibrous substrate preform approximately perpendicular to the fibrous substrate preform.

5. The process according to claim 1 wherein the fibrous substrate preform comprises fibers selected from the group consisting of rayon, polypropylene, cellulose, polyesters, and mixtures thereof.

6. The process according to claim 1 wherein the fibrous substrate preform has an average fiber length, $f_l$ of from about 10 mm to about 60 mm.

7. The process according to claim 6 wherein the molded, textured, spunlaced, nonwoven is embossed.

8. A process for forming a molded, textured, spunlaced, nonwoven web comprising the steps of:

directing a first at least one jet of water on to the fibrous substrate preform before placing the fibrous substrate preform in contact with a forming screen;

placing a fibrous substrate preform in contact with the forming screen, wherein the forming screen comprises an upper mesh member having a height, $h_c$, and an underlying mesh member in intimate contact with the upper mesh member, and wherein the fibrous substrate preform has an average fiber length, $f_l$, wherein $f_l$ is greater than $h_c$;

subjecting the fibrous substrate preform to a hydroentanglement process wherein a second at least one jet of water is directed on to the fibrous substrate perform. wherein the second at least one jet of water is directed on to the fibrous substrate preform while concurrently placing the fibrous substrate preform in contact with the forming screen, and wherein the molded, textured. spunlaced, nonwoven web is formed without apertures.

9. The process according to claim 8, wherein the upper mesh member has an effective open diameter, $d_c$ and the underlying mesh member has an effective open diameter, $d_f$, and wherein $d_c^2/d_f^2$ is greater than or equal to about 50 and is less than or equal to about 300.

10. The process according to claim 8, wherein the forming screen further comprises a rotatable cylinder.

11. The process according to claim 8, wherein the at least one jet of water is directed on to the fibrous substrate preform in a direction that is approximately perpendicular to the fibrous substrate preform.

12. The process according to claim 8, wherein the second at least one jet of water is directed on to the fibrous substrate preform in a direction that is approximately perpendicular to the fibrous substrate preform.

13. The process according to claim 8, wherein the fibrous substrate preform is selected from the group consisting of carded substrate preform and airlaid substrate preform.

14. The process according to claim 8, wherein the fibrous substrate preform comprises fibers selected from the group consisting of rayon, polypropylene, cellulose, polyesters, and mixtures thereof.

15. The process according to claim 8, wherein the fibrous substrate preform has an average fiber length, $f_l$ of from about 10 mm to about 60 mm.

* * * * *

UNITED STATES PATENT AND TRADEMARK OFFICE

CERTIFICATE OF CORRECTION

PATENT NO. : 7,530,150 B2
APPLICATION NO. : 11/890195
DATED : May 12, 2009
INVENTOR(S) : Jonathan Paul Brennan et al.

It is certified that error appears in the above-identified patent and that said Letters Patent is hereby corrected as shown below:

Col. 11
Claim 1
Line 26, delete "perform" and insert -- preform --.

Col. 12
Claim 8
Line 14, delete "intimate" and insert -- direct --.
Line 20, delete "perform." and insert -- preform --.
Line 25, delete "." and insert -- , --.

Signed and Sealed this

Thirteenth Day of April, 2010

David J. Kappos

David J. Kappos
*Director of the United States Patent and Trademark Office*